US006008786A

United States Patent [19]

Kimura et al.

[11] Patent Number: 6,008,786

[45] Date of Patent: Dec. 28, 1999

[54] METHOD FOR DRIVING HALFTONE DISPLAY FOR A LIQUID CRYSTAL DISPLAY

[75] Inventors: Yasuhiro Kimura, Yamato; Haruhiro Matino, Kanagawa-ken, both of Japan

[73] Assignee: International Business Machines Corporation, Armonk, N.Y.

[21] Appl. No.: 08/832,640

[22] Filed: Apr. 4, 1997

[30] Foreign Application Priority Data

May 22, 1996 [JP] Japan ..... 8-127173

[51] Int. Cl.[6] ..... G09G 3/36

[52] U.S. Cl. ..... 345/89; 345/153

[58] Field of Search ..... 348/181, 500; 345/150, 22, 88, 153, 155, 89; 349/74

[56] References Cited

U.S. PATENT DOCUMENTS

| | | | |
|---|---|---|---|
| 3,877,009 | 4/1975 | Kanie et al. | 345/150 |
| 4,278,972 | 7/1981 | Wozniak | 348/500 |
| 4,789,854 | 12/1988 | Taylor | 358/22 |
| 4,847,683 | 7/1989 | Lang | 358/31 |
| 4,956,638 | 9/1990 | Larky et al. | 340/701 |
| 5,012,163 | 4/1991 | Alcorn et al. | 358/32 |
| 5,170,152 | 12/1992 | Taylor | 340/703 |
| 5,189,407 | 2/1993 | Mano et al. | 345/88 |
| 5,309,170 | 5/1994 | Takashi et al. | 345/89 |
| 5,337,068 | 8/1994 | Stewart et al. | 345/88 |
| 5,369,432 | 11/1994 | Kennedy | 348/181 |
| 5,566,010 | 10/1996 | Ishii et al. | 349/74 |
| 5,604,513 | 2/1997 | Takahashi et al. | 345/153 |
| 5,606,339 | 2/1997 | Tsong et al. | 345/22 |

FOREIGN PATENT DOCUMENTS

| | | | |
|---|---|---|---|
| 0 347 720 | 6/1989 | Japan | G09G 3/36 |

*Primary Examiner*—Richard A. Hjerpe
*Assistant Examiner*—Ronald Laneau
*Attorney, Agent, or Firm*—Jay P. Sbrollini

[57] ABSTRACT

To correct the dependency of the transmissivity/applied voltage characteristics on color, a computing circuit is provided for generating corrected gray scale data by performing an addition or subtraction of the gray scale level related to at least one color. A delay circuit delays the gray scale data for uncorrected colors to maintain synchronization between the gray scale signals of all colors.

13 Claims, 6 Drawing Sheets

Transmissivity
1.0
0.8
0.6
0.4
0.2
0
B
G
R
0.5
1.0
1.5
2.0
2.5
3.0
3.5
4.0
4.5
(V) Applied Voltage y
0.8
0.6
0.4
0.2
0
G
L63
L0
R
B
0
0.2
0.4
0.6
X

FIG. 6

| Gray Scale | Condition |
|---|---|
| 0 - 3 | A |
| 4 - 10 | B |
| 11 - 53 | C |
| 54 - 60 | B |
| 61 - 63 | A |

FIG. 7

| Condition | Addition/ Subtraction Amount |
|---|---|
| A | 0 |
| B | −2 |
| C | −4 |
| ⋮ | ⋮ |

METHOD FOR DRIVING HALFTONE DISPLAY FOR A LIQUID CRYSTAL DISPLAY

FIELD OF THE INVENTION

The subject invention related to driving methods and control mechanisms in TFT liquid crystal displays (TFTLDCs). In particular, the subject invention relates to driving methods and control mechanisms for TFTLCD'S: in which the transition for each color in halftone display is effectively prevented.

BACKGROUND ART

The reduction in size of electronic equipment has been accompanied by an increase in the use of liquid crystal displays (LCDs). The LCD is not only used as a computer screen, but also is used as a television screen, a projection screen, etc. Utilizing liquid crystal has advantages such as low power consumption due to low driving voltage, and relatively fast response. It is expected that the field of application of LCDs will expand in the future.

Most of the currently used LCDs are of the active matrix type. The active matrix type means the one in which a separate driving circuit element is provided for each pixel to improve display characteristics. Active matrix LCDs using thin-film three-terminal transistors (TFTs) as switching elements are called TFT liquid crystal displays (TFTLCDs).

In using TFTLCDs to display pictures, it is necessary to provide gray scale data of the picture to the LCD to drive the LCD. FIG. 1 shows the construction of the control unit of the TFTLCD. The array/cell portion 1 of the LCD is connected to an X-driver 3 and a Y-driver 5. The X-driver 3, when it is supplied with gray scale data, applies a voltage corresponding to the gray scale data to the cell. The Y-driver 5 is connected to the gate of a switching element, and conducts/does not conduct the voltage applied to the cell by the X-driver 3 at a predetermined time.

Gray scale data is supplied to the X-driver by data control unit 10. The data control unit 10 consists of a data control circuit 12 for latching and storing the externally supplied R/G/B data in a buffer, and a timing control circuit 14 for outputting the gray scale data stored in the buffer to the X-driver 3 at a predetermined time. A clock signal is externally supplied to the data control circuit 12 and the timing control circuit 14 to control the timing. A power supply 7 is connected to the X-driver, Y-driver 5, and data control unit 10.

To display a picture on an LCD, a voltage corresponding to the gray scale is provided to each pixel of each color. That is, the driving of a pixel is not a simple on-off function, a voltage divided into several levels (gray scales) is provided to adjust the transmissivity of the pixel, so that intermediate color intensity can be displayed. To achieve such control in a color display, R/G/B signal levels are supplied to each pixel. For a display of a 64-level gray scale, 64-step voltage is used, and the voltage for each pixel is applied according to the respective gray scale data. Ideally, the same transmissivity can be achieved for all the colors when the voltage corresponding to a particular gray scale is used. The relationship for this is shown in FIG. 2. In FIG. 2, transmissivity is plotted on the ordinate, and applied voltage is plotted on the abscissa. Applied voltage is determined by the gray scale data. Accordingly, when a certain gray scale n is chosen, the applied voltage Vn is determined by that gray scale. Then, according to the relationship of FIG. 2, transmissivity Tn for the gray scale Vn is achieved.

Ideally, the relationship between gray scale, applied voltage, and transmissivity is the same for each of the R/G/B colors. However in actuality, the gray scale and the achieved transmissivity have a slight difference depending on color. This is because the degree of light modulation for the specific twist of the twisted noematic liquid crystal is slightly different depending on wavelength. That is, even though a light passes through a liquid crystal layer in a similarly twisted state, the degree of the modulation given to the passing light is wavelength dependent, and thus the scattering of brightness that occurs for a given gray scale is color dependent. This is shown in FIG. 3. The transmissivity of blue (B) is higher than that of both red (R) and green (G) for the same voltage over a wide range of applied voltage. That is, since the relationship between gray scale and applied voltage for each color is unique, the transmissivity of blue (B) is greater even if each color is selected with the same gray scale and the same voltage is applied in the displaying of intermediate colors. Thus, the correlation between transmissivity and applied voltage (hereinafter referred to as transmissivity/applied voltage characteristics) has a color (wavelength) dependency. If the displaying is performed without providing any correction, the graduation of color translates to blue more than called for by the halftone data, and the picture on the whole takes on a bluish hue. FIG. 4 shows this state represented by a chromaticity diagram. FIG. 4 shows that L63 should be a white color state if an ideal state could be realized, but in actuality, L0, or a shift to blue, occurs because of the wavelength dependency of the transmissivity/applied voltage characteristics.

Various methods have been proposed for correcting the above problem. These methods are roughly divided into (1) methods for making the correction by the modification of the structure of LCD, and (2) methods for making the correction by using electric control.

A typical example of the first category (1) is the adoption of a multi-gap structure. A multi-gap structure is a structure in which the thickness of the color filter of the pixel of each color of R/G/B varies. That is, the thickness (gap) of the liquid crystal sealing portion is changed to achieve the matching of the transmissivity/applied voltage characteristics for each color. However, implementation of a multi-gap structure is accompanied by difficulties in the manufacturing process. Problems occur in the adjustment of the thickness of the color filter, and in the uniformization of the gap between the two glass substrates forming the liquid crystal cell. Yield is effected by these difficulties causing an increase in manufacturing cost.

As an example of the second category (2), is a method in which the reference voltage (gray scale voltage) given to the data driver is tailored to the characteristics for each color. This method can compensate for the color dependency of the transmissivity/applied voltage characteristics. However, the circuits needed to independently control the reference voltages, raise the cost and cause difficulties in the implementation. Another method that falls within this second category, is to use the voltage for one of the colors of R/G/B as a reference voltage, and use offset voltages for each of other colors. This methods has the same problems as the method in which the reference voltages are separately applied, and in addition, cannot accomplish desired effect if the gradients of the curves showing the transmissivity/applied voltage characteristics of R/G/B vary with applied voltage. That is, in accordance with the offset voltage method, correction is carried out by applying a uniform offset voltage for all applied voltages, and thus the correction cannot be effectively performed unless the gradients of the curves showing the transmissivity/applied voltage characteristics are the same over the whole applied voltage range.

Japanese Published Unexamined Patent Application No. 01-101586 discloses a technique in which different liquid crystal driving voltage levels are set for each of the colors, and that level is applied to each pixel. Japanese Published Unexamined Patent Application No. 03-6986 discloses a technique in which the driving voltage is made to vary a predetermined voltage from color to color to obtain uniformity in transmissivity. Japanese Published Unexamined Patent Application No. 03-290618 discloses a technique in which a similar object is accomplished by independently inputting a gray scale control signal for each color.

Therefore, first object of the subject invention is to provide a driving method for a TFTLCD in which the dependency on color of the transmissivity/applied voltage characteristics is effectively corrected.

A second object of the subject invention is to realize the effective correction using a very simple method which enables the above described correction to be made without increase in complexity of the control method, and the restrictions on the implementation by addition of circuits.

SUMMARY OF THE INVENTION

In accordance with the present invention, the above described problems are solved by gray scale data (a bit string for a color liquid crystal display) wherein the data control means includes a computing circuit for performing an addition or subtraction of the gray scale related to at least one color to generate a corrected gray scale, and also includes delay means for delaying the outputting of the uncorrected gray scales, during the time which the gray scale of the one color is being corrected.

BRIEF DESCRIPTION OF THE DRAWINGS

FIG. 6 is a diagrammatic view of the condition determination table in the data control unit according to the subject invention;

FIG. 7 is a diagrammatic view of the addition/subtraction table in the data control unit according to the subject invention;

PREFERRED EMBODIMENT

Figure 1:
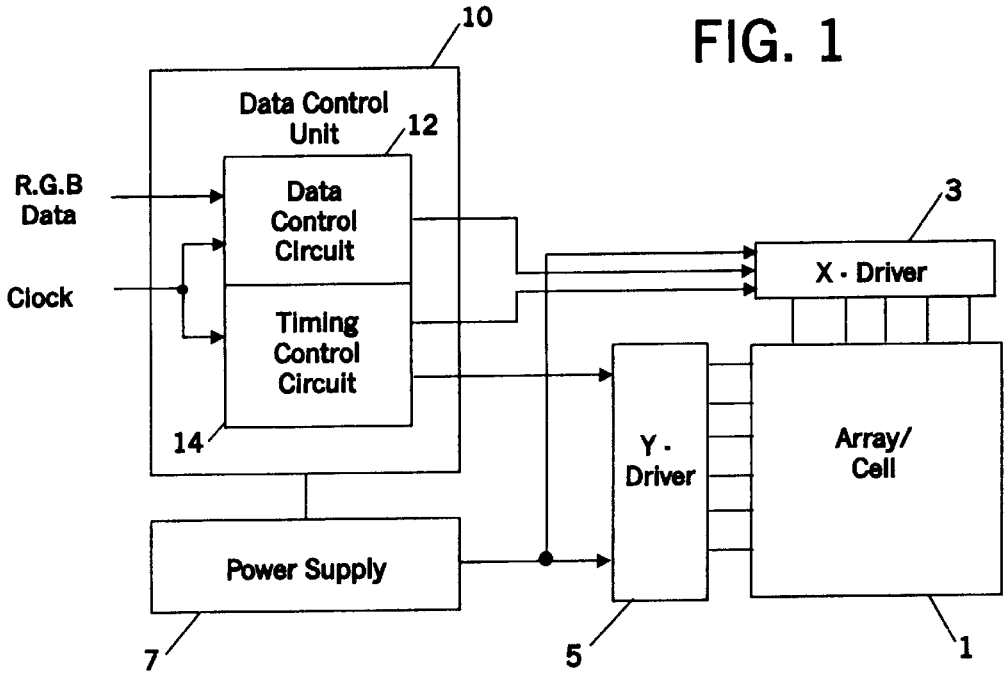
FIG. 1 is a diagrammatic view of the driving circuit for TFTLCD according to the background art.
Figure 2:
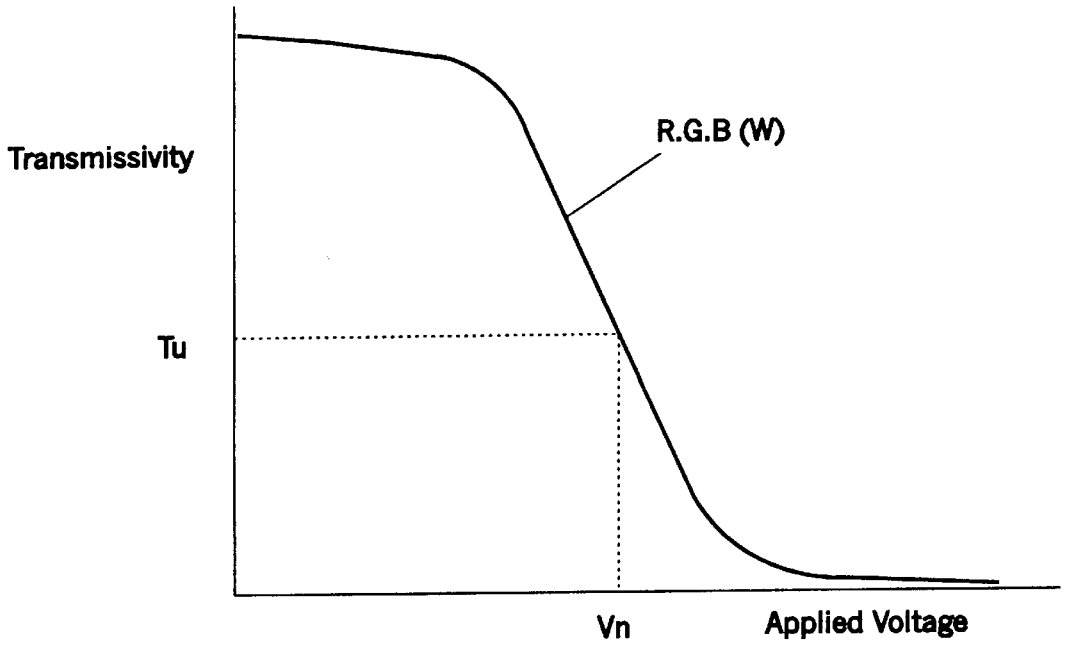
FIG. 2 is a graph showing the transmissivity/applied voltage characteristic in an ideal color LCD.
Figure 5:
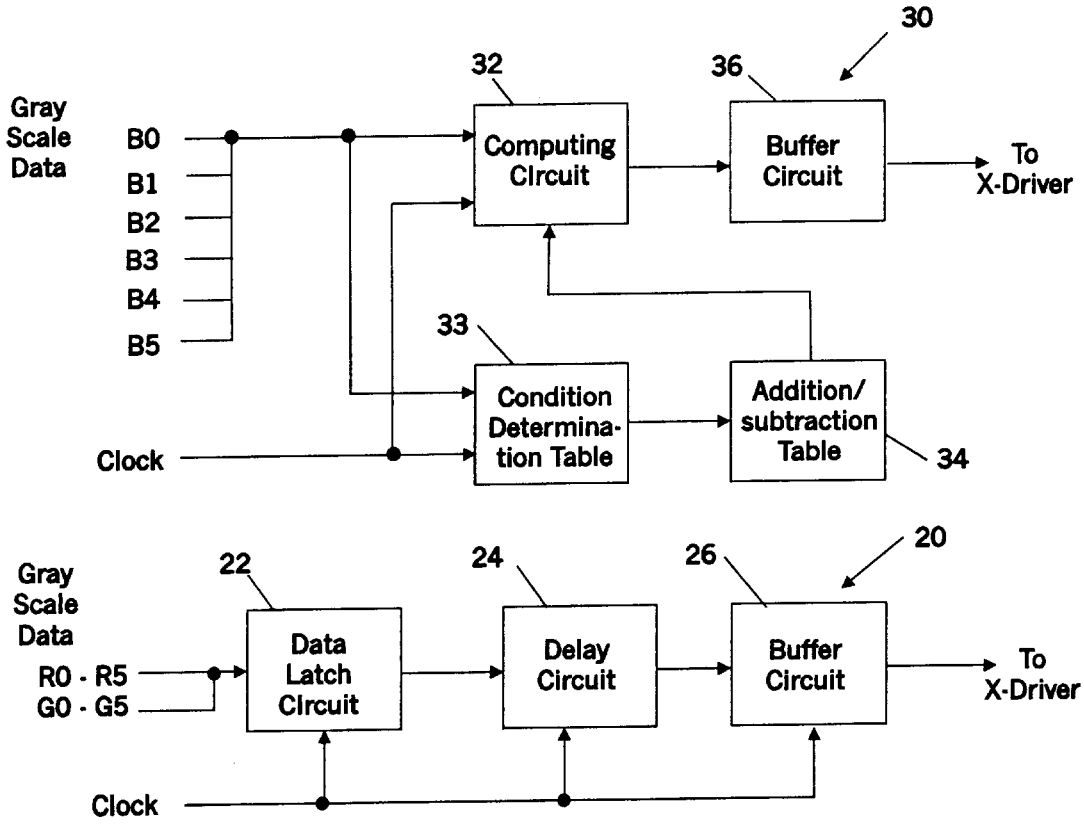
FIG. 5 is a diagrammatic view of the data control unit in the driving circuit for TFTLCD according to the subject invention.

The subject invention can be realized by improving the data control unit 10 of FIG. 1 as is shown in FIG. 5. In the background art, the data control unit consists only of a latch and a buffer. However, in the subject invention, the gray scale data related to a color, that is to be corrected, is temporarily inputted to a computing circuit. An addition or subtraction operation is applied to that gray scale data to shift it by one or more gray scale levels, to thereby achieve transmissivity equivalent to the other colors which are not to be corrected.

In FIG. 5, the color to be corrected is blue (B), and the colors which are not to be corrected are red (R) and green (G). The gray scale data related to R or G are shown by R0 to R5 or G0 to G5 in FIG. 5.

A portion 20 to which gray scale data related to R and G are inputted includes a data latch circuit 22 and a buffer circuit 26, like that in the data control unit in the background art. However, in addition to the data control unit in the background art, it includes a delay circuit 24. This is to compensate for the time during which the gray scale data B0 to B5 related to B is operated on by a computing circuit 32 in accordance with a condition determination table 36, as described later. The delay circuit 25 thereby assumes the outputting of the R and G gray scale data to the driver with the same timing as the corrected B gray scale data.

The gray data B0 to B5 for blue is a bit string for representing a 64-level gray scale. It is comprised of a bit string (B0, B1, B2, B3, B4, B5). For instance, if the gray scale is "4", (B0, B1, B2, B3, B4, B5)=(001000), and if the gray scale is "28", (B0, B1, B2, B3, B4, B5)=(001110). The same applied for R0 to R5 or G0 to G5 which are the gray scale data for reg or green, respectively.

Circuit 30 is for adjusting the Blue gray scale data B0 to B5. To accomplish this, the gray scale data related to Blue is first supplied to a computing circuit 32. In the computing circuit 32, the gray scale data for blue is reduced, for instance, by zero to four levels in comparison with the grey scale data for red and green. By correcting gray scale data in this way, results in matching the transmissivity of blue to that of Red and Green.

Further, the gray scale data for Blue is also supplied to a condition determination table 33. The condition determination table 33 determines the amount of the adjustment of the gray scale data. A diagrammatic representation of the condition determination table 33 is shown in FIG. 6. As shown, conditions A to C, corresponding to various gray scale levels, are set in the condition determination table 33. The condition corresponding to a gray scale is outputted from the condition determination table 33 to an addition/subtraction table 34. The addition/subtraction table 34 has the function of setting the actual amount of the addition or subtraction. A diagrammatic representation of the addition/subtraction table 34 is shown in FIG. 7. That is, the addition/subtraction tables set the amount to be added or subtracted according to the condition provided from the condition determination table 33. The amount of the addition or subtraction to correct the gray scale is supplied to the computing circuit 32.

Figure 8:
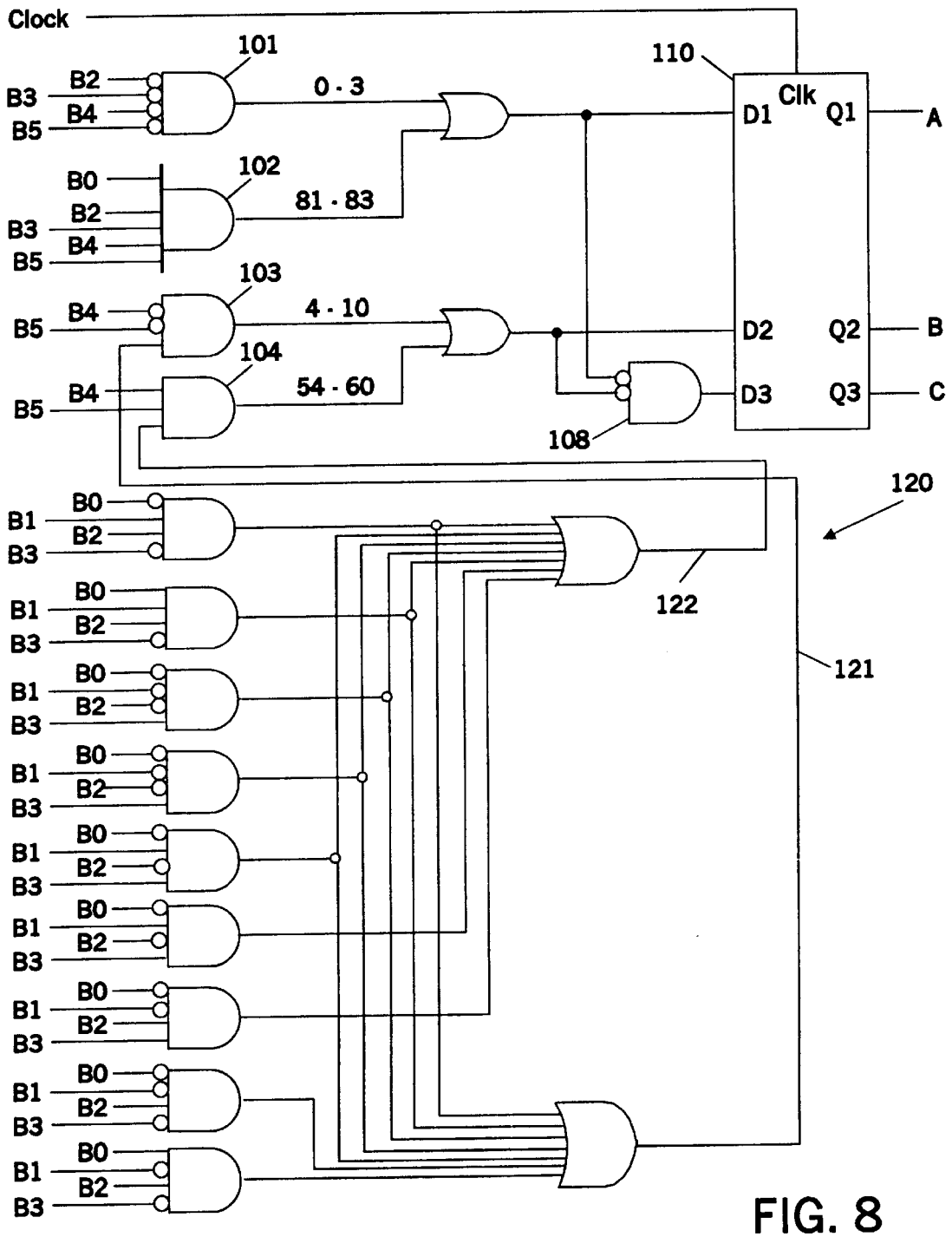
FIG. 8 is a circuit for implementing by hardware the condition determination and the condition determination table in the data control unit according to the subject invention.

The condition determination table 33 and the addition/subtraction table 34 can be implemented by software. The condition determination table can also be implemented by hardware by using the logic circuit shown in FIG. 8. To implement the specific conditions represented in FIG. 6, the gray scale data B0 to B5 are inputted to the logic circuit as shown. The gray scale data of B2 to B5 are inverted and inputted to an AND circuit 101 to create a condition corresponding to condition A in FIG. 6 for gray scale levels 0 to 3. Similarly, the gray scale data B0, B2 to B5 for gray scale levels 61 to 63 corresponding to condition A is inputted into AND circuit 102. The outputs of the AND circuit 101 and the AND circuit 102 are inputted to an OR circuit 106, and the condition A is outputted by circuit 110. AND circuit 103 and AND circuit 104 are circuits for generating condition B. Inputted to ANDs 103 and 104 is an output 122 separately created in a group of logic circuits 120, to thereby output the condition B for desired gray scale data levels 4 to 10 and 54 to 60. If there is no output from OR circuits 106 and 107, condition C is set. In this case, an output is provided by an AND circuit 108 to the circuit 110 to achieve the generation of condition C. Conditions A, B, and C are outputted from Q1 to Q3 of the circuit 110.

Figure 3:
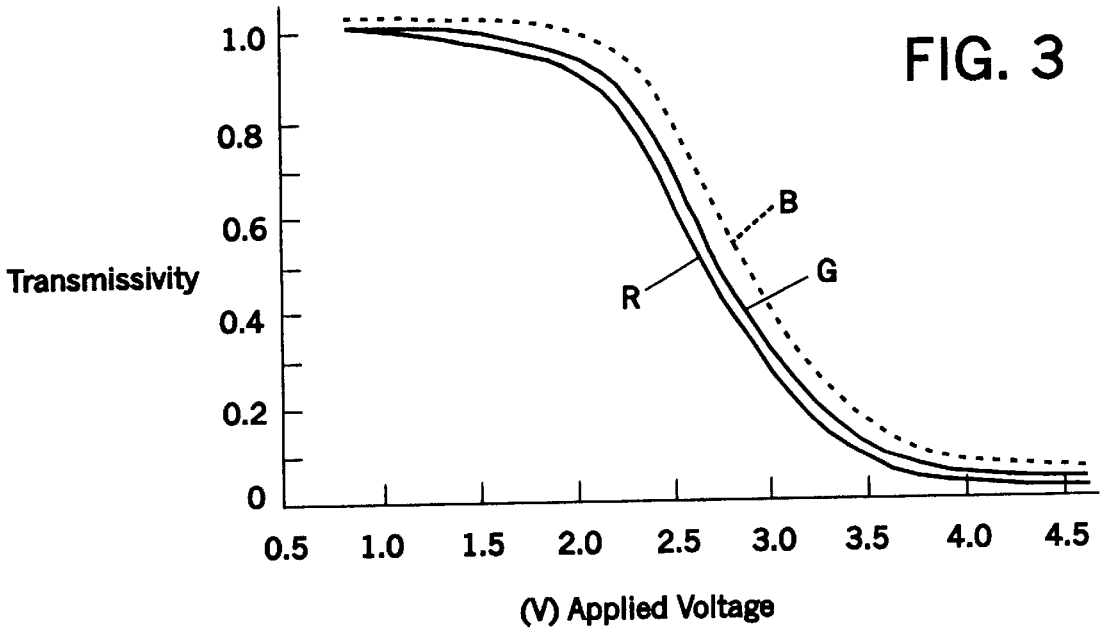
FIG. 3 is a graph showing the transmissivity/applied voltage characteristic of the color LCD in the background art.
Figure 4:
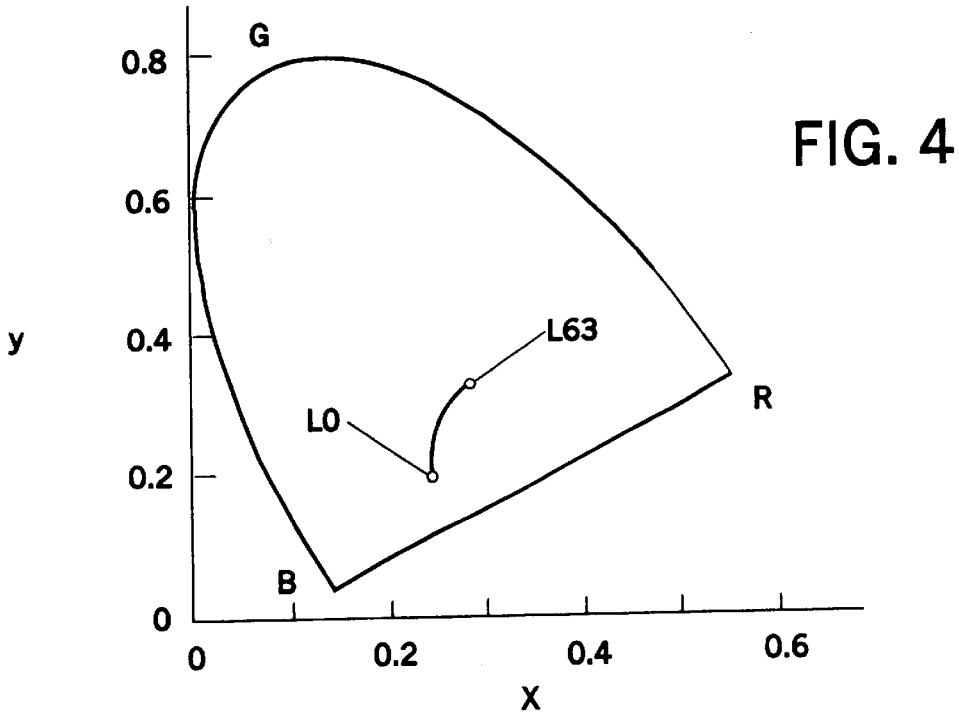
FIG. 4 is a chromaticity diagram showing an example of the color transition of the color LCD in the background art.

Operation of the circuit 30 to which gray scale data for blue is inputted, and of the circuit 20 to which gray scale data related to Red and Green are inputted is as follows. When a gray scale level "2" is received, or (B0, B1, B2, B3, B4, B5)=(010000) is inputted, the input to the display is determined by the condition determination table 33. As shown in FIG. 6, in the condition determination table 33, the condition A is outputted to the addition/subtraction table 34, and thereafter, in the addition/subtraction table 34, "0" is outputted to the computing circuit as the addition or subtraction amount as shown in FIG. 7. Accordingly, the gray scale "2" is provided unconnected to the X-driver via a buffer circuit 36. The above described processing causes a predetermined delay. Thus, the gray scale data for Red and Green corresponding to the gray scale data related to Blue are delayed for time taken for the processing by a delay circuit 24. As a result, the gray scale data related to B is outputted from the buffer circuit 36 to the X-driver is synchronized with the gray scale data for Red and Green for simultaneous output from the buffer circuit 26 to the X-driver.

Where the gray scale data level is "20," or the grey scale level signal (B0, B1, B2, B3, B4, B5)=(001010), the condition determination table 33 provides condition C signal to the addition/subtraction table 34 as shown in FIG. 6. In response, the addition/subtraction table 34 provides a signal to the computing circuit to subtract four grey scale levels (the amount as shown as −4 in FIG. 7). Accordingly, the gray scale level "20" is corrected by the computing circuit 32 to a gray scale level "16"(20−4=16) which level is provided to the X-driver via the buffer circuit 36. In this way, corrections are made to the transmissivity/applied voltage characteristics where, as shown in FIG. 3, they are not uniform for each color.

Figure 9:
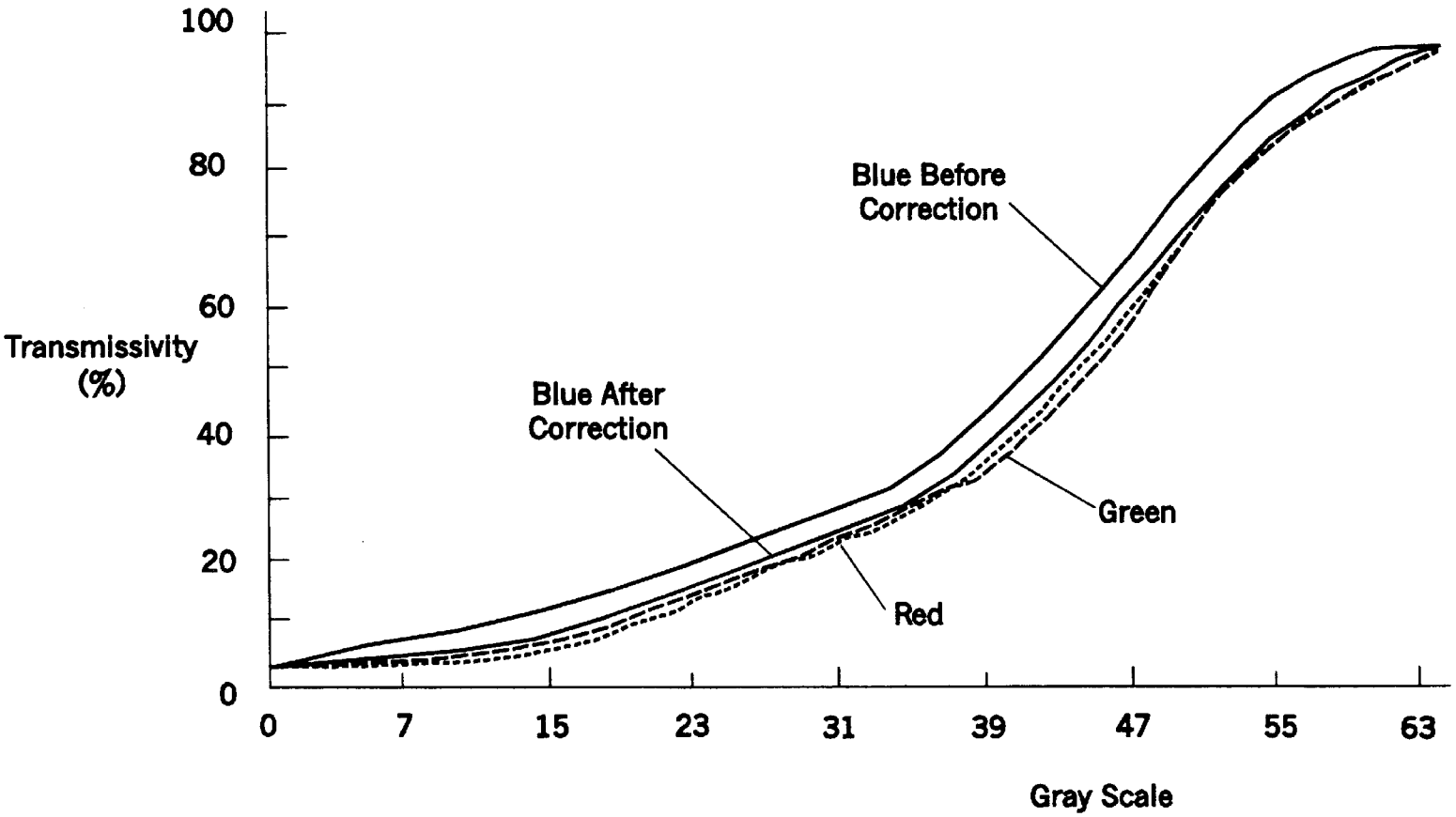
FIG. 9 is a graph showing the transmissivity/applied voltage characteristic corrected by the driving circuit for TFTLCD according to the subject invention.

FIG. 9 shows the affect the correction of the present invention has on the transmissivity/applied voltage characteristics. In this figure, the ordinate indicates transmissivity and the abscissa indicates gray scale level all of R/G/B, the same transmissivity is achieved for the same gray scale level. Thus, it is seen that the problem of the subject invention of effectively correcting the difference in the dependency of the transmissivity/applied voltage for each color has been solved.

In accordance with the subject invention, the difference in the dependency of the transmissivity/applied voltage characteristics for each color can be effectively compensated for. Further, the amount of the adjustment can be varied with the grey scale level for accurate compensation.

With the method of the subject invention, only an additional circuit such as a computing circuit, is needed to effectively correct the differences in the transmissivity/applied voltage characteristics for colors. The above correction is made while avoiding the problems in complexity of control methods in the background art. That is, to implement the subject invention, only a condition determination circuit is needed in the data control circuit. It is not necessary to change the structure of the X-driver or the structure of the cell.

Although, in this embodiment, the gray scale data related to B has been made to match the gray scale data related to R and G by performing a subtraction thereof, it should be self evident to those skilled in the art that an addition of the gray scale data related to Red and Green can be used to match the gray scale data for those colors with the gray scale data related to Blue using the teaching of the present invention. Therefore, it should be understood that many changes can be made in the described embodiment without departing from the spirit and scope of the present invention.

We claim:

1. A liquid crystal color display comprising:

a) a display cell containing a light transmitting medium, b) driver means connected to said display cell for driving the display cell with sets of grey scale data signals each signal for a different color, and c) data control means for receiving gray scale data signals related to the setting of a gray scale for the display cell and outputting said gray scale data signals to said driver with a predetermined timing, wherein said data control means includes:

i) computing means for changing the level of the gray scale data signals for at least one color relative to the other colors to a different gray scale level to compensate for a variation in intensity between the colors due to wavelength related differences in transmissivity between the colors through the light transmitting medium, and ii) buffer means for delaying any uncorrected gray scale signal related to the other colors for the time delay caused by said corrected gray scale data signal being corrected.

2. A liquid crystal color display of claim 1 wherein: said data control means comprises adjusting means for varying the amount of correction accorded to the gray scale data signals for said at least one color.

3. A liquid crystal color display of claim 1 wherein: said adjusting means is for the data control means to simultaneously output the corrected and uncorrected gray scale data signals.

4. A liquid crystal color display of claim 1 wherein: said correction performed by said data control means includes an addition or subtraction of the voltage representing at least one gray scale level for at least one color.

5. A method of gray scale data control for eliminating the effect wavelength dependency of transmissivity of light in a multicolor display cell comprising:

changing the level of gray scale data signals related to at least one of the multicolors supplied to the display cell to create a corrected gray scale data signal with a level different from the inputted gray scale data signal to compensate for differences in transmissivity of the colors that result from wavelength dependence, and synchronizing the output of the gray scale data signals by delaying the output for at least one other of the multicolor by the time taken for correction of said at least one color to simultaneously output the gray scale data of all said multicolors.

6. A gray scale control method of claim 5 wherein said correction includes an adding or subtracting voltage level representations of at least one gray scale of said at least one color.

7. A liquid crystal multicolor display comprising:

a) display cells containing a light transmitting medium, b) driver circuits connected to said display cells for driving the display cells with sets of gray scale data signals each driver circuit for a different one of the colors, i) calculation logic in the driver circuit of at least one color for changing the level of the gray scale data signals of said at least one color to a different gray scale level to compensate for color distortion due to wavelength related differences in transmissivity between the colors through the light transmitting medium, and ii) delay logic in the driver circuit for any other of the colors without the calculation logic in its driver circuit for delaying the gray scale signals for the other of the colors to synchronize the provision of the sets of gray scale data signals by compensating for the delay caused by the calculation logic.

8. The liquid crystal color display of claim 7 wherein said data calculation logic provides adjustments for varying the amount of correction in accordance with the level of the gray scale data signals provided to said calculation logic.

9. The liquid crystal display of claim 8 wherein said at least one color is blue and said any of the other colors are red and green.

10. The liquid crystal display of claim 7 wherein said calculation logic includes a tabular lookup table providing different corrective values at different gray scale levels.

11. A liquid crystal color display of claim 10 wherein said correction performed by said data control means includes an addition or subtraction of the binary signal representing a change of at least one gray scale level for at least one color.

12. A method of gray scale data control for reducing the effect wavelength dependency on transmissivity of light in cells of a multicolor display comprising:

changing the gray scale data signals related to one of the multicolors to correct for the wavelength dependency of transmissivity and thereby create a corrected gray scale data signal different from the inputted gray scale data signal for that color, and synchronizing the timing of the gray scale data signals by delaying the output for any other color of the multicolors with gray scale data signals not subject to a correction by the amount of time taken for correction of the one color to synchronize the timing of the gray scale data signals for all said multicolors.

13. The method of claim 12 including varying the magnitude of the corrective change as a function of the gray scale level of said one of the multicolors.

* * * * *

US006008786C1

(12) EX PARTE REEXAMINATION CERTIFICATE (8013th)

United States Patent

Kimura et al.

(10) Number: US 6,008,786 C1

(45) Certificate Issued: Feb. 8, 2011

(54) METHOD FOR DRIVING HALFTONE DISPLAY FOR A LIQUID CRYSTAL DISPLAY

(75) Inventors: Yasuhiro Kimura, Yamato (JP); Haruhiro Matino, Kanagawa-ken (JP)

(73) Assignee: Chimei Innolux Corporation, Chu-Nan Site, Hsinchu Science Park, Chu-Nan, Miao-Li County (TW)

Reexamination Request:
No. 90/009,617, Dec. 8, 2009

Reexamination Certificate for:

| | |
|---|---|
| Patent No.: | **6,008,786** |
| Issued: | **Dec. 28, 1999** |
| Appl. No.: | **08/832,640** |
| Filed: | **Apr. 4, 1997** |

(30) Foreign Application Priority Data

May 22, 1996 (JP) ..... 8-127173

(51) Int. Cl.
*G09G 3/36* (2006.01)

(52) U.S. Cl. ..... 345/89; 345/597

(58) Field of Classification Search ..... None
See application file for complete search history.

(56) References Cited

FOREIGN PATENT DOCUMENTS

| | | |
|---|---|---|
| JP | S61-156097 | 7/1986 |
| JP | H02-184891 | 7/1990 |
| JP | H02-193188 | 7/1990 |
| JP | H02-271389 | 11/1990 |

*Primary Examiner*—Christina Y Leung

(57) ABSTRACT

To correct the dependency of the transmissivity/applied voltage characteristics on color, a computing circuit is provided for generating corrected gray scale data by performing an addition or subtraction of the gray scale level related to at least one color. A delay circuit delays the gray scale data for uncorrected colors to maintain synchronization between the gray scale signals of all colors.

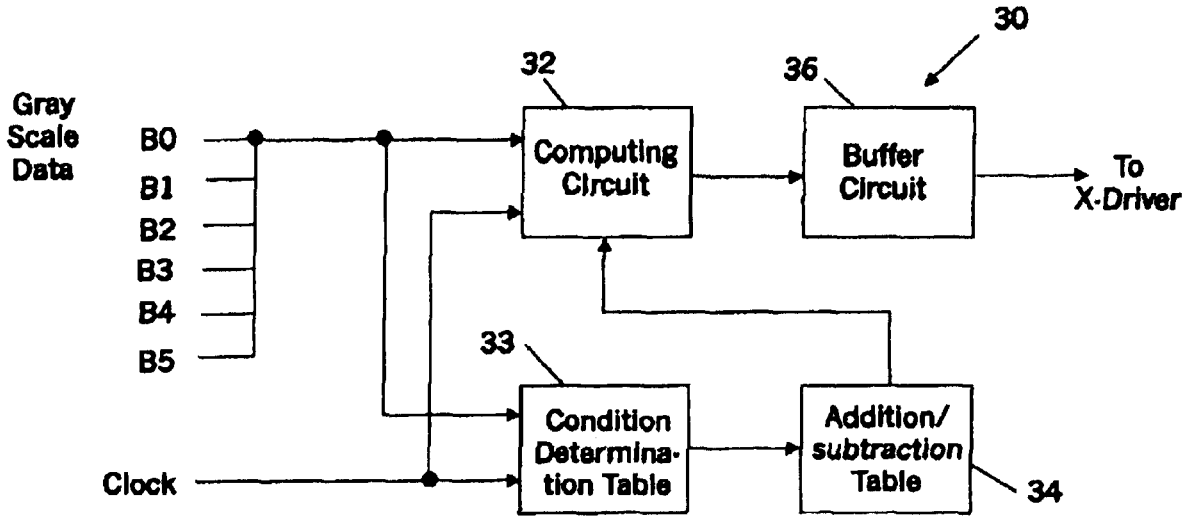

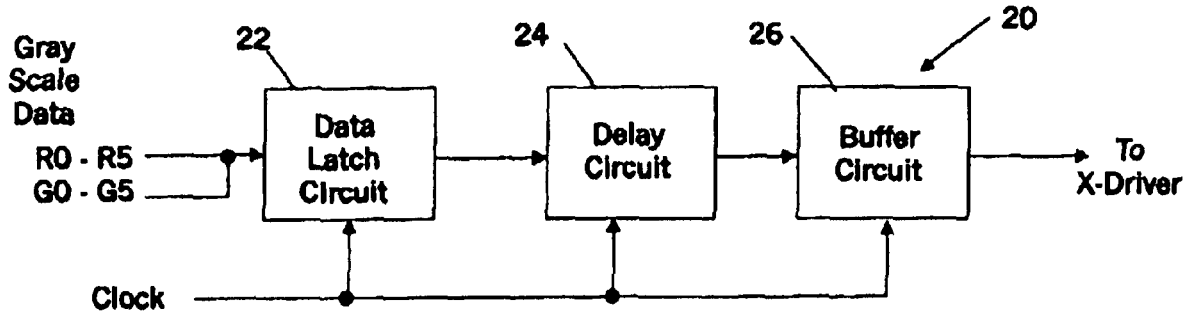

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 5, 6, 12 and 13 is confirmed. Claims 1-4 and 7-11 were not reexamined.

* * * * *

US006008786C2

(12) EX PARTE REEXAMINATION CERTIFICATE (9593rd)

United States Patent
Kimura et al.

(10) Number: US 6,008,786 C2
(45) Certificate Issued: Apr. 11, 2013

(54) METHOD FOR DRIVING HALFTONE DISPLAY FOR A LIQUID CRYSTAL DISPLAY

(75) Inventors: Yasuhiro Kimura, Yamato (JP); Haruhiro Matino, Kanagawa-ken (JP)

(73) Assignee: Chimei Innolux Corporation, Chu-Nan Site, Hsinchu Science Park, Chu-Nan, Miao-Li County (TW)

Reexamination Request:
No. 90/012,150, Feb. 17, 2012

Reexamination Certificate for:

| | |
|---|---|
| Patent No.: | **6,008,786** |
| Issued: | **Dec. 28, 1999** |
| Appl. No.: | **08/832,640** |
| Filed: | **Apr. 4, 1997** |

Reexamination Certificate C1 6,008,786 issued Feb. 8, 2011

(51) Int. Cl.
*G09G 3/36* (2006.01)

(52) U.S. Cl.
USPC ..... 345/89; 345/597

(58) Field of Classification Search ..... None
See application file for complete search history.

(56) References Cited

To view the complete listing of prior art documents cited during the proceeding for Reexamination Control Number 90/012,150, please refer to the USPTO's public Patent Application Information Retrieval (PAIR) system under the Display References tab.

*Primary Examiner* — Behzad Peikari

(57) ABSTRACT

To correct the dependency of the transmissivity/applied voltage characteristics on color, a computing circuit is provided for generating corrected gray scale data by performing an addition or subtraction of the gray scale level related to at least one color. A delay circuit delays the gray scale data for uncorrected colors to maintain synchronization between the gray scale signals of all colors.

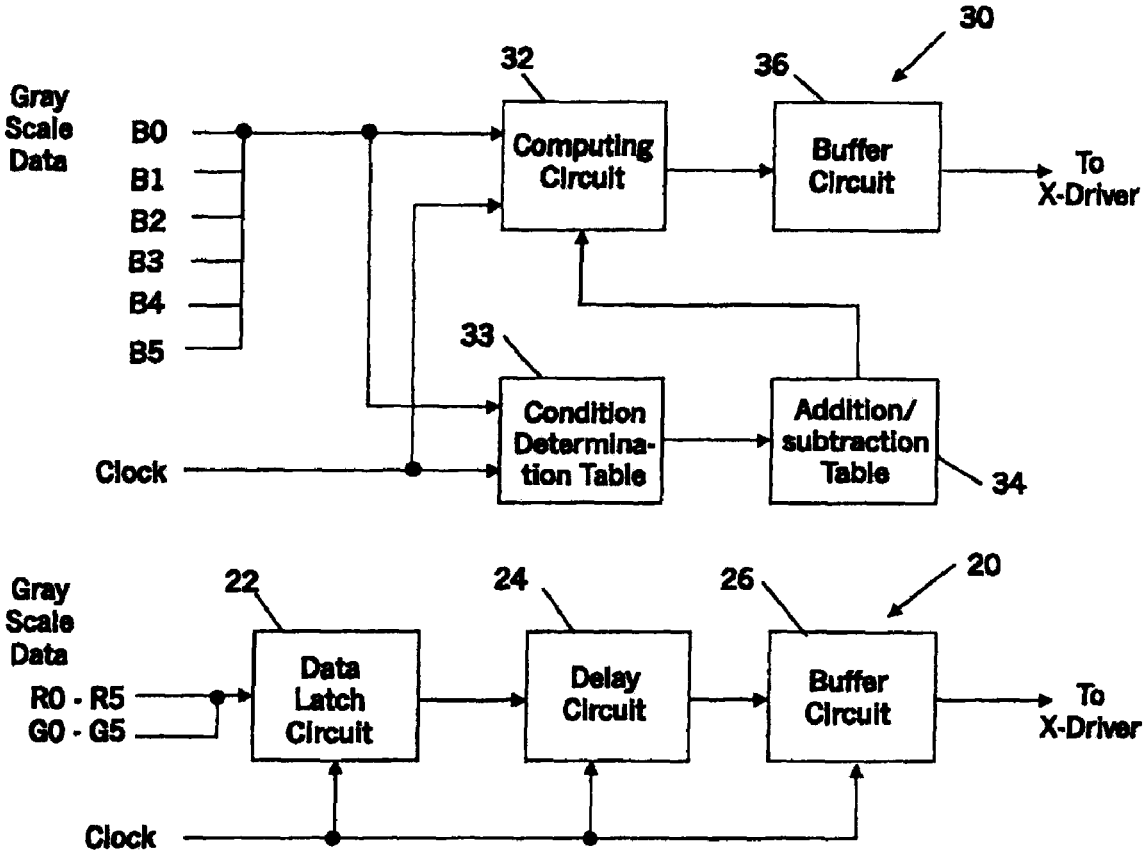

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 5, 6, 12 and 13 is confirmed.

New claims 14-21 are added and determined to be patentable.

Claims 1-4 and 7-11 were not reexamined.

*14. The method of claim 5, wherein the level of gray scale data signals related to at least one of the multicolors is adjusted by a predetermined amount to create said corrected gray scale data signal with said level different from the inputted gray scale data signal.*

*15. The method of claim 14, further comprising determining a condition of the inputted gray scale data signal from a plurality of conditions of gray scale data signals, and selecting the predetermined amount based on the condition of the inputted gray scale data signal.*

*16. The method of claim 15, wherein each condition of the plurality of conditions corresponds to a range of values of gray scale data signals.*

*17. The method of claim 14, wherein the predetermined amount is selected based on the level of the inputted gray scale data signal to compensate for differences in transmissivity of the colors that result from wavelength dependence.*

*18. The method of claim 12, wherein the gray scale data signals related to one of the multicolors is adjusted by a predetermined amount to create said corrected gray scale data signal different from the inputted gray scale data signal for that color.*

*19. The method of claim 18, further comprising determining a condition of the inputted gray scale data signal from a plurality of conditions of gray scale data signals, and selecting the predetermined amount based on the condition of the inputted gray scale data signal.*

*20. The method of claim 19, wherein each condition of the plurality of conditions corresponds to a range of values of gray scale data signals.*

*21. The method of claim 18, wherein the predetermined amount is selected based on the inputted gray scale data signal to correct for the wavelength dependency of transmissivity.*

* * * * *